United States Patent [19]

Galockin

[11] Patent Number: 4,742,939

[45] Date of Patent: May 10, 1988

[54] REMOTE SODA-CIRCULATING BEVERAGE DISPENSER

[75] Inventor: Longin Galockin, Deerfield, Ill.

[73] Assignee: Automation Projects Inc., Highland Park, Ill.

[21] Appl. No.: 888,643

[22] Filed: Jul. 24, 1986

Related U.S. Application Data

[63] Continuation of Ser. No. 648,677, Sep. 10, 1984, abandoned.

[51] Int. Cl.[4] ..... B67D 5/08; B67D 5/62

[52] U.S. Cl. ..... 222/68; 222/129.1; 222/146.6; 222/318; 222/424; 137/101.27; 366/137

[58] Field of Search ..... 222/129.1–129.4, 222/146.6, 318, 68, 424, 67; 62/389, 393, 394, 396; 137/563, 101.27; 366/144, 147, 339, 137, 136, 159

[56] References Cited

U.S. PATENT DOCUMENTS

| | | | |
|---|---|---|---|
| 3,011,681 | 12/1961 | Kromer | 222/146.6 X |
| 3,162,323 | 12/1964 | Kromer | 222/146.6 X |
| 3,215,312 | 11/1965 | Guzzi | 222/146.6 X |
| 3,223,388 | 12/1965 | Knox | 366/339 |
| 3,266,672 | 8/1966 | Dean | 222/129.1 |
| 3,731,845 | 5/1973 | Booth | 222/318 X |
| 3,813,010 | 5/1974 | Hassell et al. | 222/146.6 X |
| 4,061,271 | 12/1977 | Kimbrough | 222/318 X |
| 4,148,334 | 4/1979 | Richards | 222/129.1 X |
| 4,304,736 | 12/1981 | McMillin et al. | 222/129.1 X |

FOREIGN PATENT DOCUMENTS 1002647 2/1957 Fed. Rep. of Germany ... 222/129.1

*Primary Examiner*—Joseph J. Rolla
*Assistant Examiner*—David H. Bollinger
*Attorney, Agent, or Firm*—Thomas R. Vigil

[57] ABSTRACT

The recirculating beverage dispenser unit comprises a cooling unit, a carbonation unit, an inlet connection between a source of fresh water and the cooling unit, a fresh water valve and spigot, a delivery conduit coupling the fresh water valve and spigot to the cooling unit, at least one mixing valve and spigot coupled by a conduit to the carbonation unit and coupled by another conduit to a source of pressurized syrup, and a pump and other conduits for circulating carbonated water from and to the at least one mixing valve and spigot to and from the carbonation unit. The carbonation unit is mounted in the cooling unit and has a refrigerant carrying conduit coiled therearound in parallel relationship with a carbonation unit water inlet conduit. A spiral baffle is positioned around the carbonation unit to direct fresh water coming into the cooling unit around the parallel coiled tubings. Syrup carrying tubings extend through and are coiled about an inner surface of the cooling unit. An electric pump is provided at the bottom of the cooling unit for circulating fresh water and for supplying fresh water to the fresh water valve and spigot. A vane pump is coupled to the fresh water delivery conduit and to the carbonated water carrying conduit through a three-way valve assembly which permits recirculation of carbonated water or the supplying of fresh water to be carbonated by a venturi charging unit to the carbonation unit.

20 Claims, 2 Drawing Sheets

REMOTE SODA-CIRCULATING BEVERAGE DISPENSER

This is a continuation of application Ser. No. 648,677, filed Sept. 10, 1984, now abandoned.

BACKGROUND OF THE INVENTION

1. Field of the Invention

The present invention relates to a carbonated beverage recirculating dispenser unit which includes a cooling unit and a carbonation unit. A fresh water valve and spigot and at least one mixing valve and spigot are coupled by various conduits to the cooling unit, the carbonation unit and at least one source of pressurized syrup.

2. Description of the Prior Art

Heretofore, various soda recirculating beverage dispenser units have been proposed which include valve and spigots which are situated at a location remote from a refrigeration unit, a carbonation unit, a cooling unit and at least one source of syrup.

Typically, these prior art dispenser units provided for refrigeration of a plurality of containers in a refrigeration compartment. A plurality of conduits were then provided for coupling the various refrigerated containers containing various liquids, e.g., fresh water, carbonated water and syrup, to and between the various valves and spigots. This usually required more than one pump, e.g. one for the fresh water and one for the carbonated water, and if the syrup was not in a pressurized container a pump for the syrup. Furthermore, the plurality of refrigerated containers required a number of conduits.

As will be described in greater detail hereinafter, the recirculating beverage dispenser unit of the present invention differs from the previously proposed dispenser units by providing a cooling unit which receives fresh water and which has mounted therein a carbonation unit in which chilled carbonated water is stored. Further, the dispenser unit of the present invention provides for super chilling of the carbonated water or fresh water being introduced into the carbonation unit, while at the same time chilling the fresh water in the cooling unit and syrup flowing through conduits that extend into and through the cooling unit. Only one vane pump is provided together with a three-way valve assembly for recirculating carbonated water or for introducing fresh water into the carbonation unit. Preferably, a venturi $CO_2$ charging unit is provided in the conduit from the pump to the carbonation unit so that the fresh water can be highly charged with $CO_2$. Further, a spiral baffle is provided in the cooling unit around the carbonation unit to direct fresh water entering, or being recirculated through, the cooling unit over the refrigerant carrying conduit in the cooling unit.

SUMMARY OF THE INVENTION

According to the present invention there is provided in a recirculating beverage dispenser unit of the type comprising a cooling unit, a carbonation unit, an inlet connection between a source of fresh water and the cooling unit, a fresh water valve and spigot, a delivering conduit coupling the fresh water valve and spigot to the cooling unit, at least one mixing valve and spigot coupled by a conduit to the carbonation unit and coupled by another conduit to a source of pressurized syrup, means for circulating carbonated water from and to the at least one mixing valve and spigot to and from the carbonation unit, and the carbonation unit being mounted in the cooling unit.

A refrigeration carrying conduit is parallel coiled with a water unit delivery conduit about the carbonation unit so that water being delivered to the carbonation unit is super chilled by its close proximity to the parallel coiled refrigerant carrying conduit.

Further, a spiral baffle is provided around the carbonation unit for directing fresh water that enters into, or which is recirculated through, the cooling unit about the carbonation unit.

Syrup carrying conduits extend into and through the cooling unit and are positioned in a coiled manner around an inner wall surface of the cooling unit. Additionally, an electric pump is positioned at the bottom of the cooling unit for supplying fresh water to the fresh water valve and spigot and for recirculating fresh water through the cooling unit.

A three-way valve assembly is coupled to the fresh water delivery conduit and to the carbonation carrying conduit and is activated by a float switch in the carbonation unit for controlling the delivery of fresh water to the carbonation unit or the recirculation of carbonated water to the carbonation unit.

A $CO_2$ venturi type charging unit is coupled in the conduit delivering water from the three-way valve assembly to the carbonation unit so that fresh water or previously carbonated water can be highly charged with $CO_2$.

A pressure sensitive switch is provided in the conduit leading to the carbonation unit so that upon sensing a high pressure, a refrigeration unit supplying refrigerant can be de-energized. Further, a pressure switch in the inlet water line can sense low pressures and de-energize the whole system to prevent dry-run and/or burn-out of the pumps when there is a drop in the inlet water pressure.

DESCRIPTION OF THE PREFERRED EMBODIMENT

Figure 1:
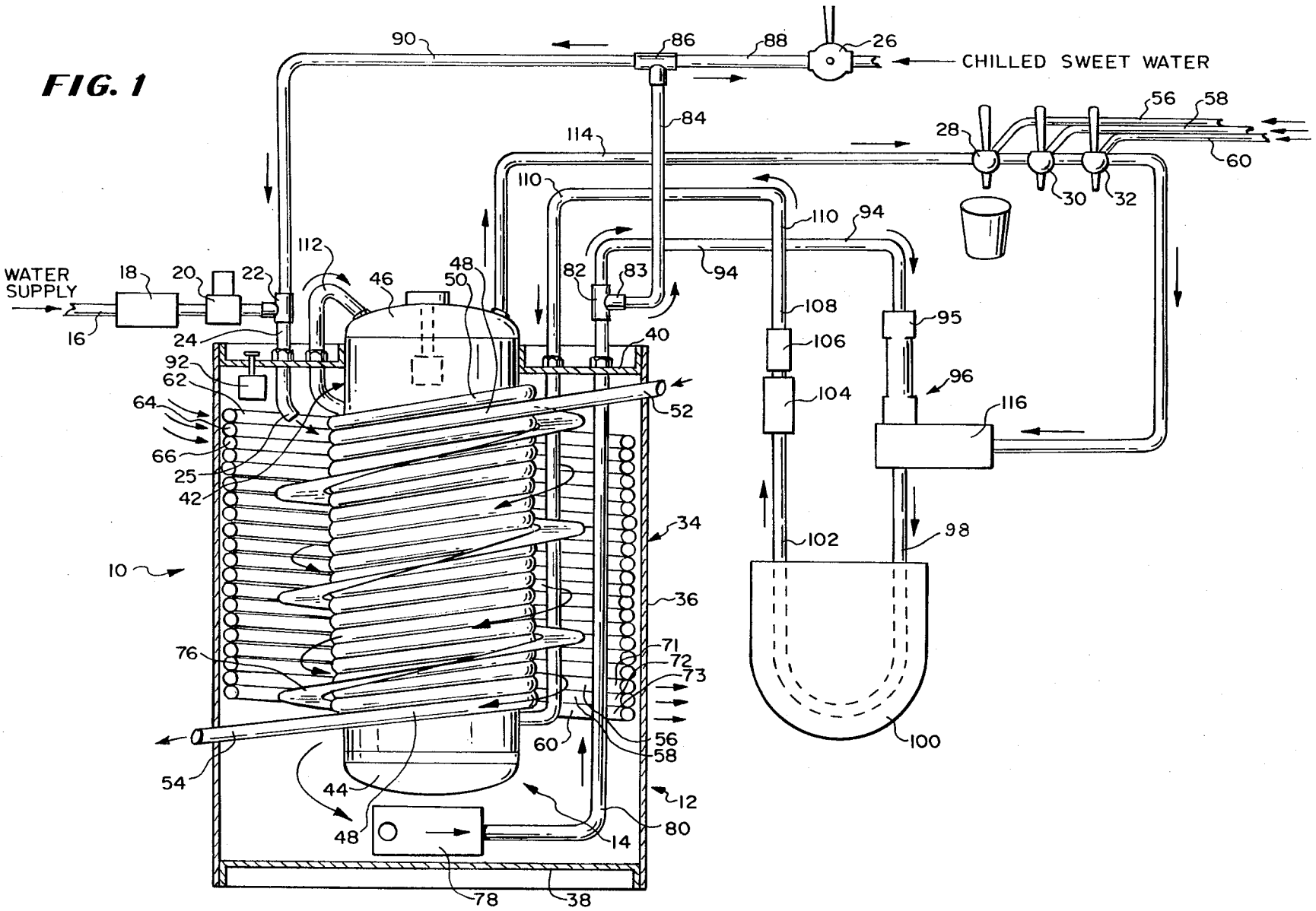
FIG. 1 is a partially mechanical, partially schematic fluid circuit diagram of the remote soda-recirculating beverage dispenser unit of the present invention and shows a cooling unit of the dispenser unit partially in cross-section.

Referring now to the drawings in greater detail, there is illustrated in FIG. 1 a remote soda-recirculating beverage dispenser unit which is constructed according to the teachings of the present invention and which is generally identified by reference numeral 10. The dispenser unit 10 includes a cooling unit 12 having a carbonation unit 14 therein. The cooling unit 12 has an inlet water conduit 16 for receiving a fresh water supply which passes through a pressure sensing switch 18 and a solenoid valve 20 to a T-coupling 22 having an outlet or downstream tubing 24 that extends downwardly into the cooling unit 12 and opens at 25 into the cooling unit 12 as shown.

Forming part of, but remote from the cooling unit 12 is a fresh water valve spigot 26, and three mixing valves and spigots 28, 30 and 32, for mixing and dispensing a mixture of carbonated water and syrup.

The cooling unit 12 includes a cylindrical tank 34 having a cylindrical sidewall 36, a bottom wall 38 and a top wall 40. Mounted within the tank 34 and fixed to and depending from the top wall 40 is the carbonation unit 14.

The carbonation unit 14 includes a cannister 42 cylindrical in shape and having a bottom wall 44 and a top wall 46.

Coiled around the cannister 42 are a pair of tubings 48 and 50. The tubing 48 has an inlet 52 which is shown extending through the cylindrical wall 36 but which, in actuality, will extend through the top wall 40. This inlet 52 of the tubing 48 is coupled to a source of coolant or refrigerant (not shown).

Likewise, an outlet end 54 of the tubing 48 carrying the refrigerant is shown extending through the cylindrical wall 36 but in actuality, will extend out of the top wall 40 of the tank 34. The second tubing 50 coiled parallel with and in between the refrigerant carrying tubing 48 carries cold water which is fed into the carbonation unit 14 as will be described in greater detail hereinafter.

Situated adjacent the inside surface of the cylindrical wall 36 of the tank 34 are three conduits 56, 58 and 60 which are coiled together in a group as shown. Each of these tubings 56, 58, 60 has an upper inlet end 62, 64 or 66 which is coupled to a conventional pressurized container of syrup, e.g. a cola syrup and fruit syrups, for making carbonated soft drinks.

Each of the tubings 56, 58 and 60 has a lower outlet end 71, 72 or 73 which extends out of the tank 34 and is connected to ones of the mixing valve and spigots 28, 30 and 32.

Again, although not shown, it is to be understood that the outlet ends 71, 72 and 73 of the tubings 56, 58 and 60 will extend through the top wall 40 of the tank 34.

All the tubings or conduits of the dispenser unit 10 extend through the top wall 40 and are sealed to the top wall by suitable fittings although not all tubings mounted in the top wall 40 are shown.

Positioned in the tank 34 and fastened in a suitable manner around the carbonation unit 14 and the parallel coiled tubings 48 and 50 extending about the cannister 42 of the carbonation unit 14, is a spiral baffle 76 which is positioned to direct fresh water coming into the tank 34 from the outlet opening 25 of the tubing 24 around the parallel coiled tubings 48 and 50.

At the bottom of the tank 34 is situated a small electrical pump 78 which is coupled to a tubing 80. The pump 78 is of the type which permits flow of water through the pump 78 into the tubing 80 so that water can be suctioned out of the tank through the tubing 80. The tubing 80 extends upwardly through the wall 40 and to a T-coupling 82. A side outlet 83 of the T-coupling 82 is connected to another tubing 84 which extends to a further T-coupling 86 which is connected to a tubing 88 leading to the valve and spigot 26. The other side of the T-coupling 86 is connected to a tubing 90 which leads to the upstream side of the T-coupling 22 and provides a return path for fresh water.

When the valve and spigot 26 is operated, it also operates an electric switch (not shown) which energizes the pump 78 so that fresh water is pumped from the bottom of the tank to the valve and spigot 26. The pump 78 is typically off for twelve minutes and then on for three minutes to periodically circulate fresh water.

Mounted at the top of the tank 34 to the top wall 40 is a float switch 92 which is coupled electrically to the solenoid valve 20. When the float switch 90 is low, the valve 20 is operated to supply fresh water to the tank 34 (provided a float switch 130 in carbonation unit 14 is also closed). The upper position of float switch 92 is such that a space is created at the top of the tank 34 to allow for expansion upon freezing of water into and around the tubings 48 and 50.

The pressure sensitive switch 18 is a high pressure or low pressure valve which will operate under a high pressure, or a low pressure of 10 psi in the inlet water conduit 16 to de-energize the dispenser unit 10 to prevent dry running of the pumps (e.g. pump 78 and pump 100) of the unit 10.

Returing to the T-coupling 82, another tubing 94 is connected thereto and leads to an inlet 95 of a three-way valve assembly 96. The three-way valve assembly 96 has an outlet 98 that is coupled to a vane pump 100. An outlet end 102 of the vane pump 100 is coupled through a high and low pressure sensitive switch 104 to a venturi $CO_2$ gas charging unit 106. An outlet 108 of the $CO_2$ charging unit 106 is coupled to a tubing 110 which extends to and into the tank 34 and is coupled to the inlet end of the tubing 50. An outlet end 112 of the tubing 50 extends through the top wall 40 to the top wall 46 of the cannister 42 for feeding fresh water or carbonated water into the carbonation unit 14.

An outlet tubing 114 from the carbonation unit 14 extends to the mixing valve and spigots 28, 30 and 32 which are connected in series in the tubing 114. The tubing 114 then extends to another inlet 116 of the three-way valve assembly 96.

As will be described in greater detail hereinafter, the vane pump 100 circulates fresh water or carbonated water through the carbonation unit 14.

Figure 2:
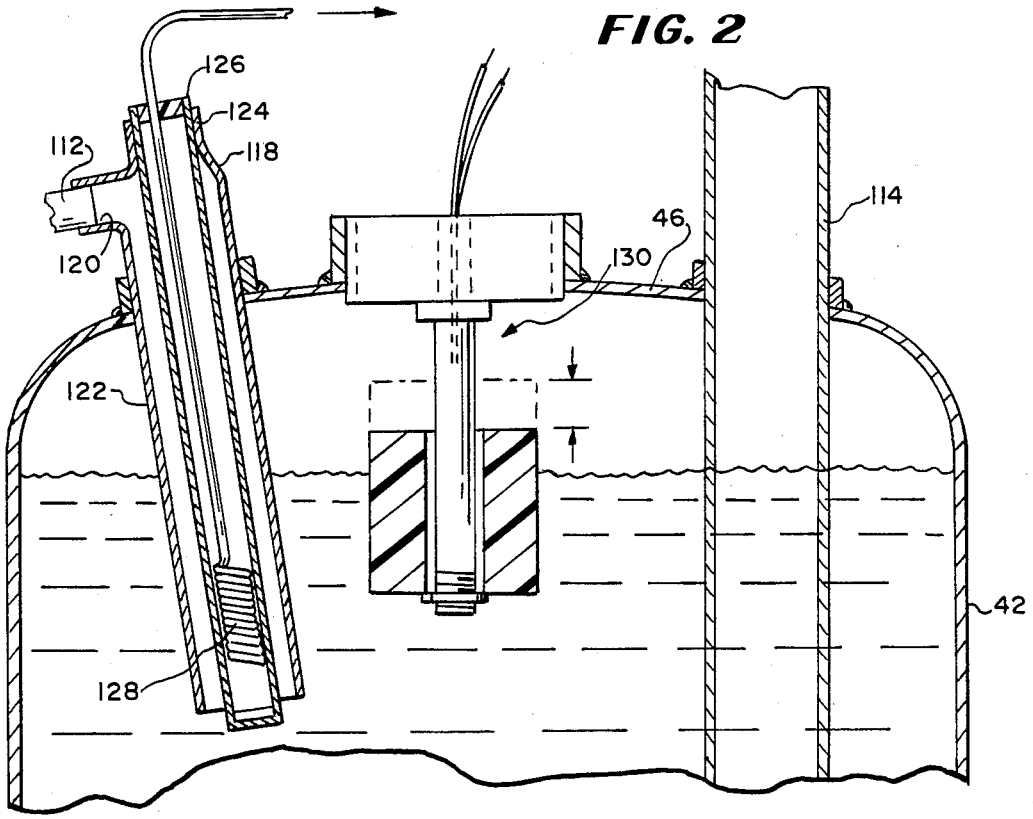
FIG. 2 is an enlarged sectional view of the upper portion of a carbonation unit shown in FIG. 1.

Referring now to FIG. 2, the outlet end 112 of the tubing 50 is coupled to an inlet of a special temperature sensing fitting 118. This fitting 118 has an inlet opening 120 and a cylindrical pipe 122 which extends downwardly through the top wall 46 of the cannister 42 into the cannister 42. Fixed to an upper end 124 of the fitting 118 is a closed end temperature sensing tube 126 which is arranged to extend downwardly coaxially with the pipe 122 thereby to form an annular passageway. Within the tube 126 is a temperature sensor 128 such as a thermocouple type sensor.

With this construction of the special fitting 118, the temperature of fresh water or carbonated water that has been cooled by the cooling coil 48 and then ejected into the cannister 42 can be measured as the water enters the cannister 42. The sensor 128 is coupled to a control circuit (not shown) for the refrigeration unit (not shown) that supplies refrigerant or coolant to the tubing 48. The special fitting 118 ensures that the exact temperature of the water entering the cannister 42 is measured so that the temperature of the water being ejected into the tank can be accurately monitored and kept at 3220 C. Without this special fitting 118, a temperature sensor in the cannister 42 may not necessarily accurately measure the temperature of the water coming into the cannister 42 of the carbonation unit 14 because of the turbulence in or thermoclines in the cannister 42.

A float switch 130 is mounted in the top wall 46 of the cannister 42 and is electrically coupled to a solenoid coil 132 in the three-way valve assembly 96.

Figure 3:
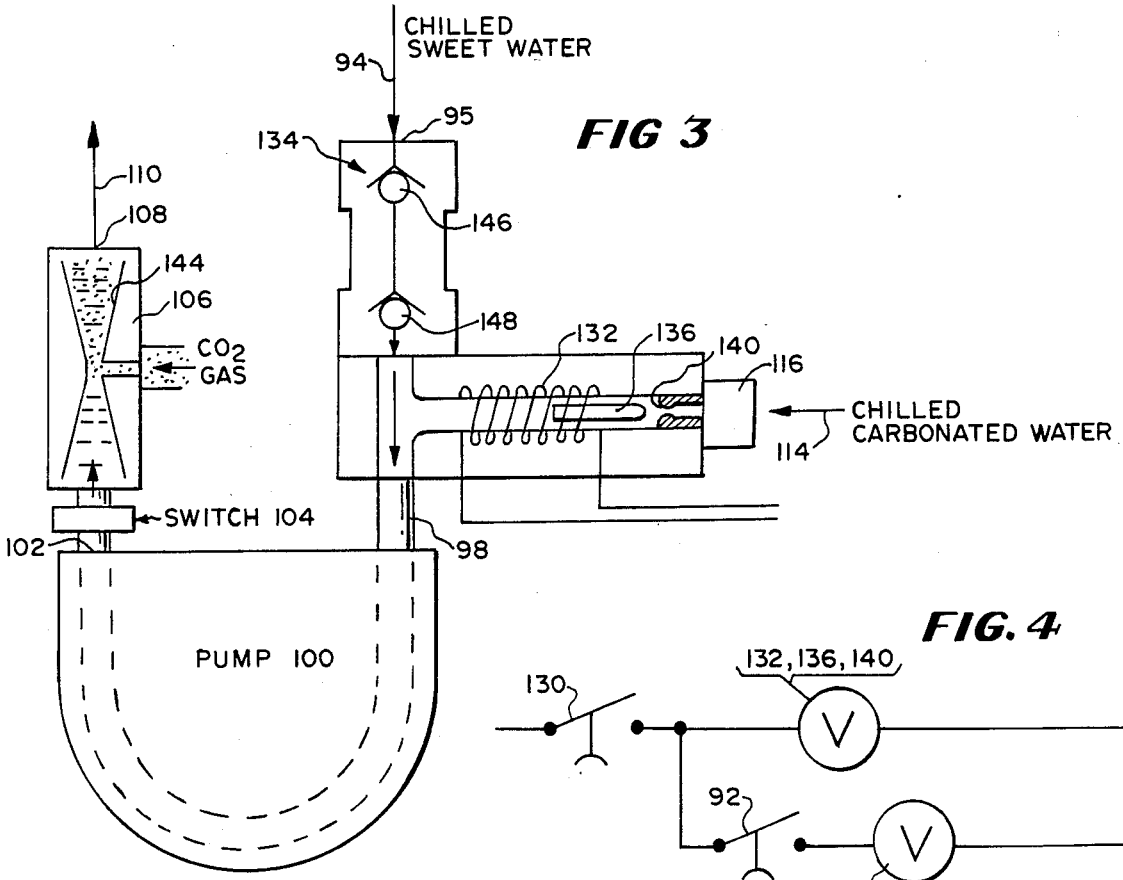
FIG. 3 is a partially schematic, partially mechanical diagram of the three-way valve for fresh water and carbonated water, a pump for circulating the fresh water and carbonated water and a $CO_2$ charging venturi unit.

Referring now to FIG. 3, the three-way valve assembly 96 includes a check valve assembly 134 to which tubing 94 is connected. The solenoid coil 132 is normally de-energized and, when energized by the lowering and closing of the float switch 130 upon a drop in the level of liquid in the cannister 42, will cause an armature 136 to move against a valve seat 140 to close the inlet 116. to which tubing 114, having chilled carbonated water therein, is coupled.

In the operation of the dispenser unit 10, fresh water will come into the inlet pipe 16 and through the pressure switch 18 and solenoid valve 20 into the tank 34 until the float switch 92 is actuated by the liquid in the tank 34 reaching a predetermined level and the float switch 130 in carbonation unit 14 reaching a predetermined level at which point the solenoid valve 20 is closed.

Once the unit 10 is energized, the refrigeration unit is also energized to supply coolant or refrigerant to the tubing 48. Also, at this time, the vane pump 100 is energized to cause water at the bottom of the tank 34 to be suctioned out of the tubing 80 carbonated and returned to the carbonation unit where the carbonated water is typically maintained at a pressure of 60 psi.

Initially, the float switch 130 will be in a lower position which will cause energization of the solenoid coil 132 thereby to cause the armature 136 to move against the valve seat 140 to close the flow of liquid through the conduit 114. The vane pump 100 will the create a low pressure causing check valve assembly 134 at the inlet 95 to open to allow fresh water to be suctioned from the bottom of the tank 34 through the tubings 80 and 94 and through the three-way valve assembly 96, vane pump 100, pressure sensitive switch 104 and venturi $CO_2$ charging unit 106 to tubing 110. In charging unit 106, $CO_2$ gas is injected into a venturi 144 of the charging unit 106, which venturi 144 causes rapid charging of the fresh water being circulated with $CO_2$. This carbonated water is then supplied to tubing 110 and tubing 50 where the carbonated water is chilled as it circulates around and from the bottom to the top of the cannister 42. Then the chilled water flows into the cannister 42 through the special fitting 118 where the temperature of the carbonated water is monitored. If the temperature is too low, the temperature sensor 128 will cause de-energization of the refrigeration unit.

This filling of the cannister 42 of the carbonation unit 14 will continue until the float switch 130 is caused to move upwardly and open circuit, indicating that the cannister 42 has been filled to a predetermined level with carbonated water and cause solenoid coil 132 to be deenergized.

Accordingly, once the cannister 42 nas been fully charged with carbonated water, continued operation of the vane pump 100 will cause circulation of the carbonated water from the top of the cannister 42 through the tubing 114 through the inlet 116 of the three-way valve assembly 96 past the floating armature 136 and through the vane pump 100. The pressure of the carbonated water is such that it will prevent the check valve assembly 134 from opening. If desired, the check valve assembly 134 can include spring biased ball valves 146 and 148 which will prevent opening of the check valve assembly 134 until there is a drop in pressure.

The pressure sensitive switch 104 will sense pressures above or below a certain range and if a low pressure or high pressure, particularly a high pressure above 100 psi, is sensed, it will cause de-energization of the refrigerating unit while leaving the vane pump 100 energized so that liquid can be circulated.

Figure 4:
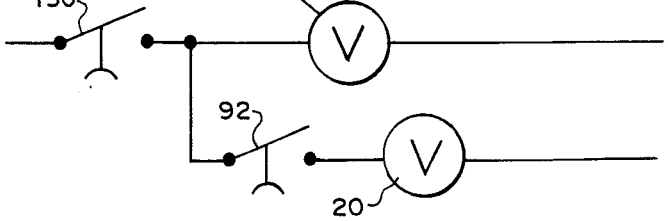
FIG. 4 is a schematic circuit diagram showing a float switch in the cooling unit for controlling a water shut-off valve in the water inlet to the cooling unit and the parallel connection therewith of a float switch in the carbonation unit which controls the energization of a refrigeration compressor for the dispenser unit.

As shown in FIG. 4, the float switch 92 is coupled in series with the float switch 130 so that both float switches have to close in order to re-energize the solenoid valve 20.

Suitable control systems of known type can be provided for operating the vane pump 100 intermittently or continuously for maintaining cold carbonated water always present at the mixing valves and spigots 28,30 and 32.

From the foregoing description, it will be apparent that the dispensing unit 10 of the present invention has a number of advantages some of which have been described above and others of which are inherent in the invention. Most importantly, the unit 10 provides a compact system for cooling (a) fresh water supplied to the unit 10, (b) syrup used with the unit 10, and (c) carbonated water which is recirculated through the cooling unit 10 to maintain cold carbonated water at the mixing valves and spigots.

The spiral baffle 76 provides means for directing the fresh water coming into the cooling unit 12 in a circular path about the cooling coil 48.

Also, the provision of the carbonated water tubing coil 50 in a parallel coiled arrangement around the cannister 42 with the refrigerant tubing 48 provides for cooling of the carbonated water and the fresh water at the same time.

Further, the float switches 92 and 130 together with the solenoid valve 20 and the three-way valve assembly 96 provide an efficient system for generating fresh carbonated water when it is required and for circulating the carbonated water so that cold carbonated water is always available at the mixing valve and spigots 28, 30 and 32.

Still further, the venturi charging unit 106 provides an efficient way for charging the fresh water with $CO_2$ while the pressure sensing switches 18 and 104 provide adequate protection for the system and prevent damage to the system if a high or low pressure is incurred.

Finally, the temperature sensor 128 mounted within the inlet pipe 122 to the cannister 42 of the carbonation unit 14 ensures that the temperature of the cooled carbonated water is accurately measured and accurately monitored.

The important features of the dispenser unit 10 are:

1. The tubing 50 carrying carbonated water and the parallel coiled refrigerant carrying tubing 48 are tightly wound around the carbonation unit 14 to provide close contact between the carbonated water and the refrigerant to "super chill" the carbonated water or fresh water being fed into the carbonation unit 14.

2. The spirally arranged baffle 76 controls the circular flow of water around the carbonation unit 14 and the parallel coiled tubings 48 and 50 therearound when water is introduced into or recirculated through the tank 34 by the pump 78.

3. Fresh pre-chilled water in the outer tank 34 flows in a circular motion over the refrigerant tubing 48 to be chilled thereby.

4. The fresh pre-chilled water also moves along the syrup carrying tubings 56, 58 and 60 to chill them and the syrup therein in a very effective way.

5. Efficient cooling of the fresh water and carbonated water is obtained by the mounting of the carbonation unit 14 in the tank 34 of the cooling unit 12 whereby both tanks are chilled simultaneously.

6. By use of the three-way valve assembly 96 only one vane pump 100 is required.

7. The provision of an air space at the top of the tank 34 provides an air cushion and space for water expansion during ice buildup around the coiled tubings 48 and 50.

8. The pressure switch 18 shuts off the entire system if the water pressure drops below 10 psi thereby protecting the motors and pumps 78 and 100 from dry run and burnout.

9. The pressure switch 104 protects the circulating water system from over pressure and shuts off the refrigeration compressor when a pressure of 100 psi is reached preventing additional pressure buildup.

10. The venturi $CO_2$ charging unit 106 creates a very high degree of carbonation.

11. The special fitting 118 with temperature sensor 128 therein enables the super chilled water entering the carbonation unit 14 to be maintained at 30° F. whereby the carbonated water in the carbonation unit 14 is maintained at 32° F.

From the foregoing description it will be apparent that modifications can be made to the dispensing unit 10 of the present invention without departing from the teachings of the invention. Accordingly, the scope of the invention is only to be limited as necessitated by the accompanying claims.

I claim:

1. A recirculating beverage dispenser unit comprising a cooling unit, a carbonation unit, an inlet connection between a source of fresh water and said cooling unit, a fresh water valve and spigot, a delivering conduit coupling said fresh water valve and spigot to said cooling unit, at least one mixing valve and spigot coupled by a conduit to said carbonation unit and coupled by another conduit to a source of pressurized syrup, means for circulating carbonated water from and to said at least one mixing valve and spigot to and from said carbonation unit, said carbonation unit being mounted in said cooling unit, said cooling unit including a first coiled tubing which is mounted about said carbonation unit in said cooling unit and which is coupled to a source of refrigerant, said first tubing forming a cooling coil for cooling water received in the cooling unit and for cooling carbonated water in said carbonation unit, said means for circulating carbonated water including a second separate tubing which extends from the at least one mixing valve and spigot into said cooling unit and which is coiled in between and in abutting and parallel relationship with said first refrigerant carrying tubing, coils of said first tubing being disposed between coils of said second tubing such that said first and second tubings appear as one continuous tubing, the inner diameters of the coils of both said first and second abutting tubings being adjacent said carbonation unit, said carbonation unit having a top, a bottom and an inlet at said top thereof, said second carbonated water carrying tubing which is coiled in an abutting interlaced relationship with and between coils of said first refrigerant carrying tubing being arranged to extend from and carry carbonated water from said bottom of said carbonation unit to said top of said carbonation unit and to said inlet, said first refrigerant carrying tubing extending from and carrying refrigerant from said top of said carbonation unit to said bottom of said carbonation unit, and a spirally arranged baffle arranged about and around said carbonation unit in the path of fresh water directed into said cooling unit.

2. The dispenser unit of claim 1 wherein said cooling unit has an electrical pump mounted in the bottom thereof and coupled to the conduit extending to said fresh water valve and spigot, said dispenser unit including a return conduit extending from said fresh water valve and spigot to said cooling uhit and said fresh water valve and spigot including an electrical switch for energizing said electrical pump whereby operation of said valve and spigot will energize said pump for supplying fresh water to said fresh water valve and spigot.

3. The dispenser unit of claim 2 further including means for periodically operating said electrical pump to circulate fresh water through said delivering conduit and said return conduit connected to said fresh water valve and spigot.

4. The dispenser unit of claim 1 including a valve in the water inlet connection and a float switch in said cooling unit which is positioned to be closed in its upper switching position for closing said valve at a level of water in the cooling unit below the top of the cooling unit whereby an air cushion is provided above the water in said cooling unit.

5. The dispenser unit of claim 1 wherein said conduit coupled to said at least one source of pressurized syrup extends through said cooling unit and is coiled about an inner side wall surface of said cooling unit whereby cold syrup is supplied to said at least one mixing valve and spigot.

6. The dispenser unit of claim 1 wherein three mixing valves and spigots are provided connected in series in the conduit extending to and from the carbonation unit, said dispenser unit further including individual conduits connected between each of the second and third mixing valves and spigots to respective second and third sources of pressurized syrup.

7. The dispenser unit of claim 6 wherein said conduits connected to the source of pressurized syrup extend through and are coiled adjacent an inner side wall surface of said cooling unit.

8. The dispenser unit of claim 1 wherein said upper end of said carbonated water carrying tubing is coupled to a special fitting extending into said carbonation unit, said special fitting comprising a pipe having a closed ended tube mounted in and extending axially therein from a sealed upper end of said fitting so as to form an annular passageway for water, such as carbonated water, flowing into said carbonation unit, and said closed ended tube having a temperature sensor therein whereby the exact temperature of the water flowing into the carbonation unit can be measured and monitored.

9. A recirculating beverage dispenser unit comprising a cooling unit having a top and a bottom, a carbonation unit, an inlet connection between a source of fresh water and said cooling unit, a fresh water valve and spigot, a delivering conduit coupling said fresh water valve and spigot to said cooling unit, at least one mixing valve and spigot coupled by a conduit to said carbonation unit and coupled by another conduit to a source of pressurized syrup, means for circulating carbonated water from and to said at least one mixing valve and spigot to and from said carbonation unit said carbonation unit being mounted in said cooling unit, said connection to a source of fresh water including a pipe extending into said top of said cooling unit for directing fresh water toward said carbonation unit mounted therein, and a spirally arranged baffle arranged about and around said carbonation unit in the path of fresh water directed into said cooling unit.

10. The dispenser unit of claim 9 wherein said cooling unit includes a coiled tubing about said carbonation unit in said cooling unit coupled to a source of refrigerant, said tubing forming a cooling coil for cooling water received in the cooling unit and carbonated water in the carbonation unit.

11. The dispenser unit of claim 10 wherein the means for circulating carbonated water includes a tubing which extends from the at least one mixing valve and spigot into said cooling unit, which is coiled in parallel relationship with the refrigerant carrying tubing, and which extends to an inlet to the carbonation unit.

12. The dispenser unit of claim 11 wherein said carbonation unit has a top and a bottom and said carbonated water carrying tubing is coiled in between said refrigerant carrying tubing and extends from the bottom of the carbonation unit to the top of said carbonation unit.

13. The dispesner unit of claim 12 wherein said upper end of said carbonated water carrying tubing is coupled to a special fitting extending into said carbonation unit, said special fitting comprising a pipe having a closed ended tube mounted in and extending axially therein from a sealed upper end of said fitting so as to form an annular passageway for water, such as carbonated water, flowing into said carbonation unit, and said closed ended tube having a temperature sensor therein whereby the exact temperature of the water flowing into the carbonation unit can be measured and monitored.

14. A recirculating beverage dispenser unit comprising a cooling unit, a carbonation unit, an inlet connection between a source of fresh water and said cooling unit, a fresh water valve and spigot, a delivering conduit coupling said fresh water valve and spigot to said cooling unit, at least one mixing valve and spigot coupled by a conduit to said carbonation unit and coupled by another conduit to a source of pressurized syrup, means for circulating carbonated water from and to said at least one mixing valve and spigot to and from said carbonation unit, said carbonation unit being mounted in said cooling unit, said fresh water inlet connection having a valve therein, said carbonation unit having a first float switch therein and said cooling unit having a second float switch therein connected in series with said float switch in said carbonation unit, and the carbonated water circulating means including a three-way valve assembly having an inlet connected to a conduit from said at least one mixing valve and spigot, an outlet coupled to a conduit emptying into said carbonation unit and a second inlet coupled to a conduit that extends into said cooling unit and haa an inlet at the bottom of said cooling unit, whereby said first float switch, when in a lower position, energizes said three-way valve assembly to close said first inlet whereby fresh water can be suctioned from the bottom of said cooling unit through said three-way valve assembly and into said carbonation unit until said carbonation unit is filled with carbonated water and whereby raising of said second float switch coupled to said valve in said fresh water inlet connection will close said valve to stop the injection of water into said cooling unit when both float switches are in the raised position.

15. The dispenser unit of claim 14 wherein the circulating means includes a pump coupled to the outlet of said three-way valve means and wherein a $CO_2$ charging unit is mounted in a conduit coupled from the outlet of said pump to said inlet of said carbonation unit.

16. The dispenser unit of claim 15 wherein said $CO_2$ charging unit includes a venturi with a side inlet coupled to a source of pressurized $CO_2$.

17. The dispenser unit or claim 14 including a high and low pressure sensing valve in the conduit between the outlet of said three-way valve assembly and the inlet to said carbonation unit for de-energizing a refrigeration unit supplying refrigerant to said cooling unit when a high or low pressure is encountered, particularly a high pressure.

18. The dispenser unit of claim 14 wherein said three-way valve assembly includes a check valve assembly in said second inlet, said check valve assembly being opened when a valve in said first inlet is closed thereby to allow fresh water to be sucked into said circulating means and supplied to said carbonation unit.

19. A recirculating beverages dispenser unit comprising a cooling unit, a carbonation unit, an inlet connection between a source of fresh water and said cooling unit, a fresh water valve and spigot, a delivering conduit coupling said fresh water valve and spigot to said cooling unit, at least one mixing valve and spigot coupled by a conduit to said carbonation unit and coupled by another conduit to a source of pressurized syrup, means for circulating carbonated water from and to said at least one mixing valve and spigot to and from said carbonation unit, said carbonation unit being mounted in said cooling unit, means for pumping carbonated water and for pumping fresh water, and said fresh water inlet connection including a pressure sensitive switch which is coupled to said pumping means and is operable on sensing a high pressure or a low pressure, particularly a low pressure, for closing said fresh water inlet connection, thereby to prevent dry running of said pumping means.

20. A recirculating beverage dispenser unit comprising a cooling unit, a carbonation unit, an inlet connection between a source of fresh water and said cooling unit, a fresh water valve and spigot, a delivering conduit coupling said fresh water valve and spigot to said cooling unit, at least one mixing valve and spigot coupled by a conduit to said carbonation unit and coupled by another conduit to a source of pressurized syrup, means for circulating carbonated water from and to said at least one mixing valve and spigot to and from said carbonation unit, said carbonation unit being mounted in said cooling unit, said circulating means including a three-way valve assembly having a solenoid and a floating armature in a first inlet end of said assembly coupled to a conduit from the at least one mixing valve and spigot, said armature being urged against a valve seat when said solenoid is energized, and a check valve assembly being provided in a second inlet of said three-way valve assembly coupled to said fresh water delivering conduit, said outlet of said three-way valve assembly being coupled to an inlet of a pump whereby energization of said pump will cause recirculating of the carbonated water or the introduction of fresh water past said check valve assembly and into said carbonation unit when said armature is seated on said valve seat.

* * * * *

UNITED STATES PATENT AND TRADEMARK OFFICE

CERTIFICATE OF CORRECTION

PATENT NO. : 4,742,939

DATED : May 10, 1988

INVENTOR(S) : Longin Galockin

It is certified that error appears in the above-identified patent and that said Letters Patent is hereby corrected as shown below:

Column 4, line 66, "3220C" should be --32°C--

Column 5, line 35, "the" should be --then--

Column 5, line 58, "deenergized" should be --de-energized--

Column 5, line 59, "nas" should be --has--

Column 6, line 16, "28,30" should be --28, 30--

Column 8, line 13, "uhit" should be --unit--

Column 9, line 2, after "unit" should be --,--

Column 9, line 28, "dispesner" should --dispenser--

Column 9, line 60, "haa" should be --has--

Signed and Sealed this

Twenty-eighth Day of April, 1992

*Attest:*

HARRY F. MANBECK, JR.

*Attesting Officer*

*Commissioner of Patents and Trademarks*